United States Patent [19]

Fukumoto

[11] Patent Number: 4,836,756

[45] Date of Patent: Jun. 6, 1989

[54] PNEUMATIC PUMPING DEVICE

[75] Inventor: Toshiyuki Fukumoto, Toyonaka, Japan

[73] Assignee: Nippon Pillar Packing Co., Ltd., Osaka, Japan

[21] Appl. No.: 53,779

[22] Filed: May 26, 1987

[30] Foreign Application Priority Data

Aug. 28, 1986 [JP] Japan ..... 61-132204[U]
Aug. 28, 1986 [JP] Japan ..... 61-132205[U]
Aug. 28, 1986 [JP] Japan ..... 61-202989
Aug. 28, 1986 [JP] Japan ..... 61-202990

[51] Int. Cl.[4] ..... F04B 43/06

[52] U.S. Cl. ..... 417/394; 417/9; 417/395; 417/473

[58] Field of Search ..... 417/9, 394, 395, 472, 417/473; 55/158

[56] References Cited

U.S. PATENT DOCUMENTS 862,867 8/1907 Fukumoto et al. ..... 417/394
2,239,270 4/1941 Jahreis ..... 417/9
2,383,486 8/1945 Isenberg et al. ..... 417/473
3,176,623 4/1965 Howerton et al. ..... 417/9
3,597,120 8/1971 Reed ..... 417/394
3,683,600 8/1972 Rice ..... 55/158 X
3,955,557 5/1976 Takagi ..... 417/394 X
4,489,779 12/1984 Dickinson ..... 417/394 X
4,681,518 7/1987 Credle, Jr. ..... 417/395

*Primary Examiner*—Leonard E. Smith
*Attorney, Agent, or Firm*—Jones, Tullar & Cooper

[57] ABSTRACT

A pneumatic pumping device incorporating a movable valve such as a bellows, are diaphragm, driven by air back pressure in a cylinder so that a liquid is drawn in and discharged by reciprocating movement of the movable valve, and in which surfaces contacting the liquid on the internal and external parts of the pumping device are formed of either a single substance or a compound of a fluororesin such as PTFE, PFA, CTFE in order to feed strong acid liquid or strong alkaline liquid without corrosion on components of the pumping device.

8 Claims, 6 Drawing Sheets

PNEUMATIC PUMPING DEVICE

BACKGROUND OF THE INVENTION

1. Field of the Invention:

The present invention relates to a pneumatic pumping device in which a movable valve performs reciprocating movement by using air back pressure, and pumping operation is carried out by the reciprocating movement.

2. Description of Prior Art:

Hitherto, there has been proposed a pneumatic pumping device in which a bellows performing reciprocating movement by back pressure of air is disposed in a cylinder so that a liquid is drawn in and discharged by the reciprocating movement, as is disclosed in Japanese Patent Official Gazette under Publication No. 56-50116 and Japanese Utility Model Laying-Open Official Gazette under Laying-Open No. 61-29078.

In such a conventional pumping device, two bellows are respectively disposed in both left and right cylinder chambers, the bellows being connected with each other through the piston rod, so that when one bellows moves either forwardly in one direction or backwardly in the returning direction by the application of air back pressure, such movement is transmitted to the other bellows through the piston rod to make the other bellows move forwardly or backwardly, thus pumping operation takes place by such reciprocating movement of the bellows.

In the conventional pneumatic pumping device of the aforesaid construction, there are provided on the outer part thereof connecting members such as fittings for connecting pipes with an intake port and a discharging port of the cylinder; bolts and nuts for assembling the cylinder, bellows and other components; and mettalic members for providing rigidity to the components of the pump.

Accordingly, when the conventional pumping device is used in a liquid of strong acid or strong alkali, it becomes soaked and the aforesaid connecting members, bolts, nuts, metallic components, etc. become corroded, broken down and out of operation.

Furthermore, the conventional pumping device is necessarily composed of a pair of horizontally disposed pumps, so that contruction of a small-sized pumping device becomes substantially impossible.

Moreover, when the pressure associated with the feeding of a chemical liquid and the heat thereof generated by the chemical reaction are applied to the components of the pump, there arises a problem of stress relaxation at joining sections of the components. Accordingly, a gap may come out at the joining section between the bellows and the cylinder, otherwise a compressive creep may attack O rings and the like provided to maintain a sealing function, resulting in a decline of such function.

Another type of pumping device is disclosed in Japanese Patent Official Gazette No. 48-20807, and according to which the pumping device is driven by hydraulic pressure and therefore hydraulic driving means such as a hydraulic pump are needed, which makes the construction rather complicated.

SUMMARY OF THE INVENTION

Accordingly, an object of the present invention is to prevent components of a pumping device such as bellows, fittings from becoming corroded by composing all inner and outer parts of the pump in contact with chemical liquid of a fruororesin whose property is corrosion resistant.

Another object of the invention is to provide a small-sized pumping device by adopting a system in which either air for application of pressure or vacuum is supplied by changing over therebetween.

A further object the invention is to simplify a pumping structure by utilizing air for application of pressure and vacuum, both sources thereof usually installed in a workshop, as a driving source.

A still further object of the invention is to prevent the occurrence of a gap at joining sections between components of a cylinder chamber due to stress relaxation, thereby securely maintaining a sealing function in areas where the sealing function is needed.

In order to accomplish the foregoing objects, a feature of the pneumatic pumping device according to the invention consists in that chemical liquid contacting surfaces of inner and outer parts of the pump are formed of a simple substance such as a fluororesin or a compound thereof such as PTFE (polytetrafluoroethylene), PFA (polymer of tetrafluoroethylene - ethylene), CTFE (chlorotrifluoro- ethylene).

In the pneumatic pump of the above composition, since the chemical liquid contacting surfaces are all formed of the simple substance or compound of fluororesin, a satisfactory condition resistant consition is attained owing to the anti-corrosion property thereof, and therefore the chemical liquid contacting surfaces of the pump are protected from being attacked by the chemical liquid not only when some chemical liquid is drawn in and discharged by the pump, but also when the pump is soaking in the chemical liquid. As a result, there is no possibility that the pump will not work due to corrosion even if liquid leakage out of the pump should occur.

Another feature of the pneumatic pumping device according to the invention consists in that the movable valve is operated by a change-over between air for application of pressure and vacuum.

That is, in the pneumatic pumping device according to the invention, since a single movable valve can be reciprocatingly moved by both the air for application of pressure and vacuum, it becomes feasible to make a simple and compact pump. Moreover, since there is no need of any piston rod in the pump to drawn in and discharge liquid, it is also possible to attain a simple and small-sized pump by forming into a double pump.

A further feature of the pneumatic pumping device according to the invention consists in that the air passage of the pump is provided with a detector for detecting leakage of liquid, and a stopping device for stopping pumping operaion in accordance with a signal detected by the liquid leakage detector.

According to the pneumatic pumping device of above construction, when a strong acid otherwise a strong alkaline liquid leaks out to the air passage on the vacuum side due to the accidental breaking down of the movable valve composed of bellows and diaphragm, the liquid leakage detector detects the leakage and stops the pumping operation. As a result, the pumping device is prevented from continuing its pumping operation with the liquid leaking, and the air passage is also protected from corrosion by the leaking liquid. Thus, various components and accessories connected to the vacuum side are kept from corrosion due to liquid leakage.

A still further feature of the pneumatic pumping device according to the invention consists in that a highly corrosion resisitant filter is disposed in the air passage. The filter is gas-permeable but not liquid-permeable.

According to such a pneumatic pumping device, even if a leaking liquid of strong acid or strong alkali should be drawn in into the air passage on the vacuum side, the liquid is shut off by the filter, and the components and accessories located downstream of the filter are prevented from corrosion.

A yet further feature of the pneumatic pumping device according to the invention consists in that a joining section between the movable valve and a housing by which the movable valve is fixed to the pump body is circumferentially welded, and that a joining section between the housing and an air tube inserted in the housing are also circumferentially welded.

According to such a pneumatic pumping device, the back pressure chamber is perfectly closed and exactly prevented from entrance of liquid. Moreover, when the pumping device in use is used soaked into a liquid, the back pressure chamber is securely kept from entrance of the liquid surrounding the pump. Accordingly, a certain quantity of liquid flow can be continuously delivered at a specified transfer speed resulting in smooth and stable pumping operation. Moreover, since the components and accessories are joined by welding, the pump structure is so strong as to endure under high pressure necessary when transferring a liquid of high viscosity, thus the durability and transfer performance of the pumping device are improved.

Other objects and features of the invention will become apparent in the course of the following description together with the accompanying drawings.

BRIEF DESCRIPTION OF THE DRAWINGS

In the drawings forming a part of the present application.

DESCRIPTION OF THE PREFERRED EMBODIMENTS

Figure 1:
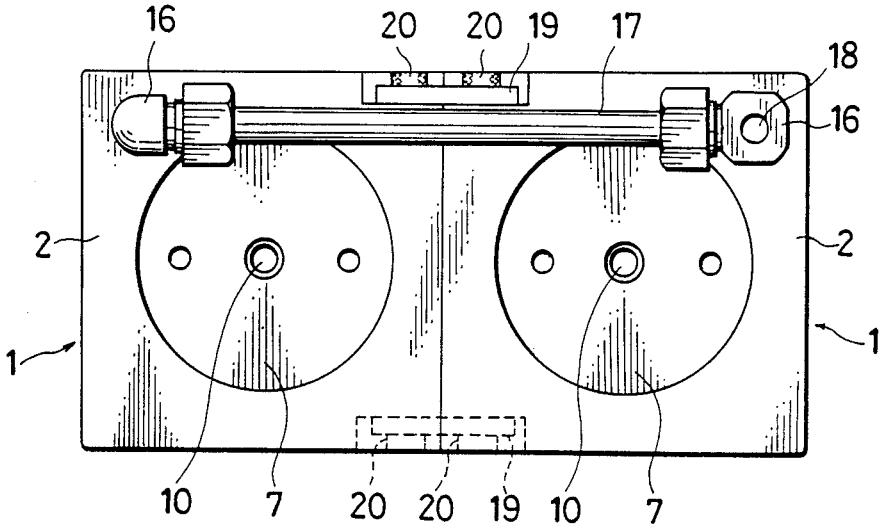
FIG. 1 is a plan view of a pneumatic pumping device according to a first embodiment of the invention.
Figure 2:
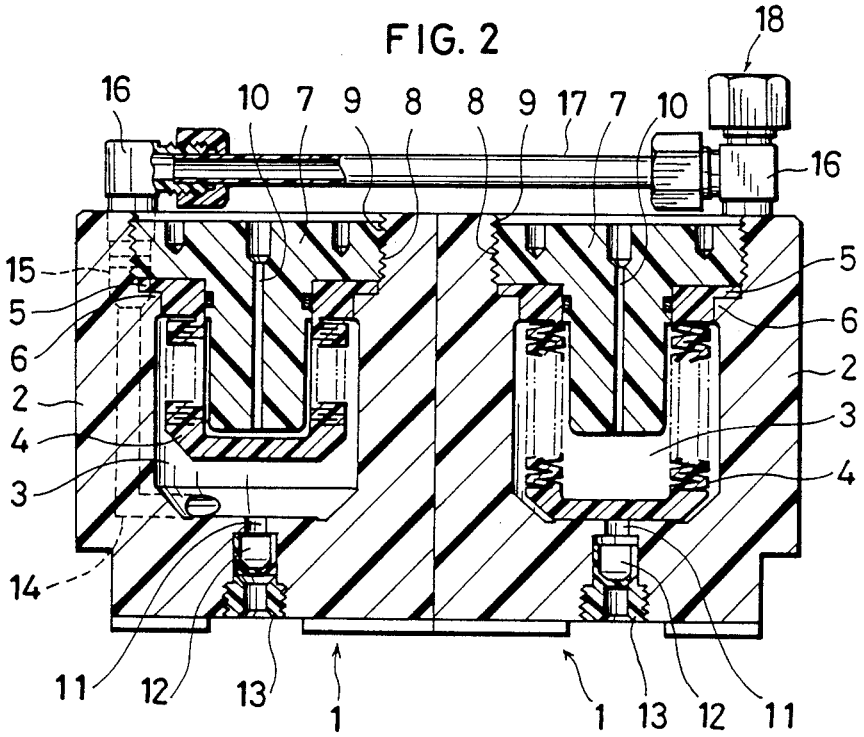
FIG. 2 is a sectional view of the pneumatic pumping device shown in FIG. 1.

A pneumatic pumping device shown in FIG. 1 and FIG. 2 is a vertical pumping device provided with pumps 1, 1 of the same structure on both left and right sides. Referring to one pump 1, a cylinder chamber 3 having a bottom extends from the upper side to the inner part of the cylinder 2 whose external appearance is like a square pillar. A bellows 4 is disposed in the cylinder chamber 3, and a flange 5 formed at the base portion of the bellows 4 is in contact with a step portion 6 of the cylinder chamber 3. A top end of a housing 7 is inserted inside the bellows 4, and a male thread 8 formed on the base portion of the housing 7 is engaged with a female thread 9 formed on the upper end portion of the cylinder chamber 3, thereby the bellows 4 being fixed to the cylinder chamber 3. An air passage 10 for applying back pressure to the bellows 4 is formed in the central portion of the housing 7. An outer end of the air passage 10 is connected to an air supply source by way of a pipe. An intake passage 11 is formed on the central bottom portion of the cylinder chamber 3, and a check valve 12 permitting intake of liquid is disposed in the passage 11. A valve seat 13 is mounted on the outside of the valve 12 by screwing. A discharging passage 14 is open on one side of the bottom of the cylinder chamber 3, and a check valve 15 permitting discharge of liquid is disposed in the passage 14.

Fitting 16, 16 are respectively engaged with ends of the discharging passages 14, 14 of the two pumps 1, 1, and the fitting 16, 16 being connected to each other through a pipe 17, and a discharging port 18 is formed at one end. In addition, the two pumps 1, 1 are fixedly connected to each other through a connecting plate 19 with bolts 20, 20.

The aforementioned pumps 1, 1 are all formed of a fluororesin. In particular, the cylinder 2, bellows 4, housing 7, connecting plate 19 and bolts 20 are made of PTFE (polytetrafluoroethylene) resin, and the check valves 12, 15, valve seat 13, fittings 16 and pipe 17 are made of either PFA (polymer of tetrafluoroetylene - perfluoroalkylvinyl ether) resin or PTFE (polytetrafluoroetylene). These resins can be replaced with CTFE (chlorotrifluoroetylene) resin when necessary. It is also preferable to coat the liquid contact faces inside and outside of the pump with aforementioned fluororesins, instead of composing the whole component of the aforementioned resins.

In the pumping device of the above construction, an air source for application of pressure is connected to one air passage 10, while a vacuum source is connected to the other air passage 10. The air source and the vacuum source are subject to change-over control. That is, referring to FIG. 2, the vacuum source is connected to the air passage 10 of the pump 1 on the left side, while the air source for application of pressure is connected to the air passage 10 of the pump 1 on the right side. Then, under such an arrangement, the air source is changed over to the vacuum source and vice versa, so that the bellows 4, 4 repeat alternately contraction and expansion, thereby carrying out the pumping operation. For example, when using the pumping device soaked in a liquid, the liquid is drawn in through the intake passage 11 and check valve 12 when the bellows 4 contracts, while the liquid is discharged out of the discharging port 18 through the discharging passage 14, check valve 15 and pipe 15 when the bellows 4 expands.

Figure 3:
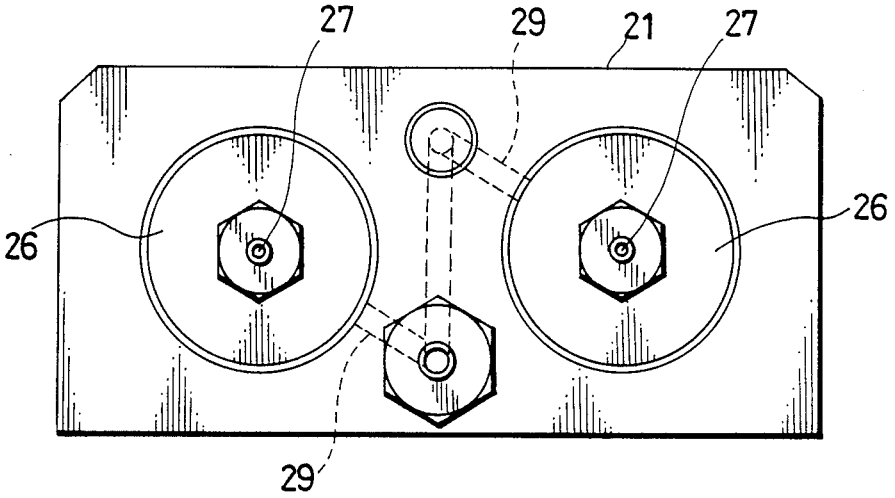
FIG. 3 is a plan view of a pneumatic pumping device according to a second embodiment of the invention.
Figure 4:
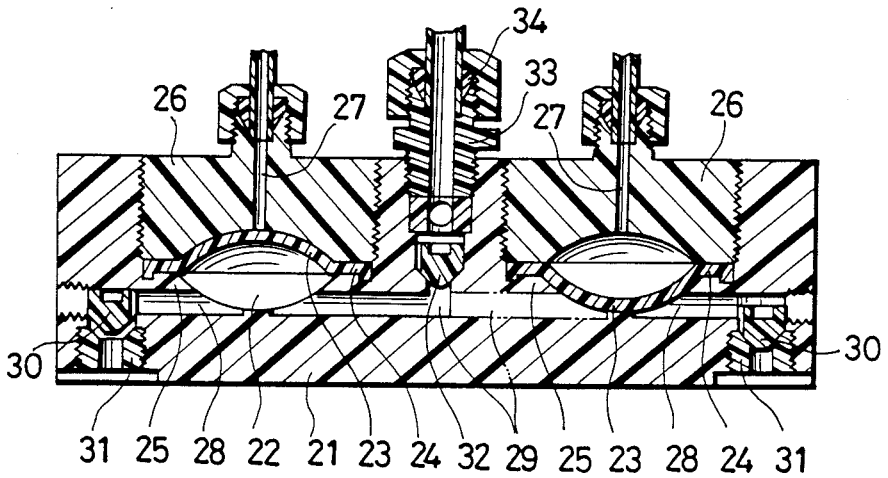
FIG. 4 is a sectional view of the pneumatic pumping device shown in FIG. 3.

FIG. 3 and FIG. 4 show a vertical pumping device with diaphragms. In this pumping device, a diaphragm 23 is disposed in the cylinder chamber 22 of the cylinder 21, and the flange 24 of the diaphragm 23 is held between the step portion 25 and the housing 26. The air passage 27 for applying back pressure to the diaphragm 23 is formed in the central portion of the housing 26. The intake passage 28 and the discharging passage 29 communicate with to the cylinder chamber 22. The check valve 30 is disposed in the intake passage 28, and the valve seat 31 is mounted on the outside of the valve 30 by screwing. Another check valve 32 permitting discharge of liquid is disposed in the discharging passage 29, and a male connector 33 and a ferrule 34 are disposed on the outside of the valve 32.

In the same manner as the preceding first embodiment described above with reference to FIG. 1 and FIG. 2, the components of the pumps 1, 1 are all made of fluororesin, an air source for application of pressure is connected to one air passage 27 while a vacuum source to the other air passage 27, and the air source and the vacuum source are subject to chang-over control.

In the pumping device of this embodiment, the diaphragms 23, 23 alternately perform reciprocating motion by the aforementioned change-over control, as a result pumping operation is continued. Thus, a liquid is draw in through the inlet pasage 28 and check valve 30 when the diaphragm 23 moves upward, while the liquid is discharged through the discharging passage 29 and check valve 32 when the diaphragm 23 moves downward.

Figure 5:
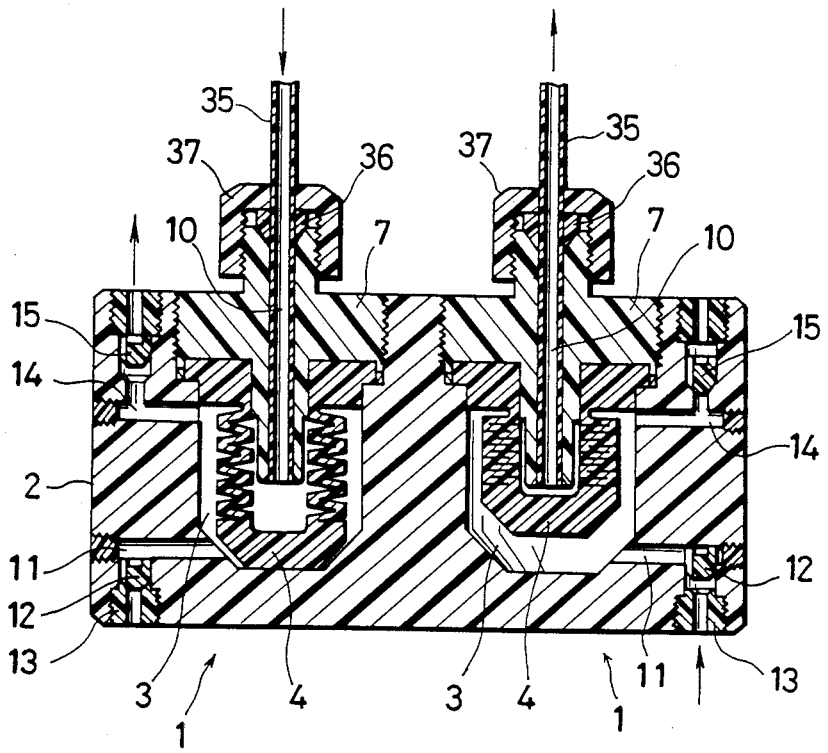
FIG. 5 is a plan view of a pneumatic pumping device according to a third embodiment of the invention.

In a pump shown in FIG. 5, an air tube 35 is inserted through the central portion of the housing 7. A ferrule 36 is mounted on the outside of the air tube 35 and engages with a screwed portion of the housing 7, and the screwed portion is tightened with a union nut 37 to secure the ferrule 36 to the conical face of the screwed portion.

In the same manner as the preceding first embodiment described above with reference to FIG. 1 and FIG. 2, the components of the pumps 1, 1 are all made of fluororesin, an air source for application of pressure is connected to one air passage 10 while a vacuum source to the other air passage 10, and the air source and the vacuum source are subject to change-over control.

Figure 6:
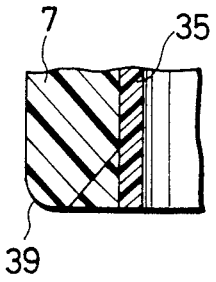
FIG. 6 is an enlarged sectional view showing a welding section of an air tube.
Figure 7:
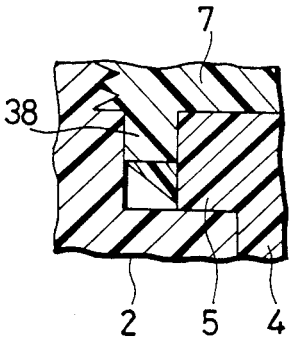
FIG. 7 is an enlarged sectional view showing a welding section of a bellows.

As shown in FIG. 7, the flange 5 of the bellows 4 and an annular projection 38 formed on the housing 7 are joined by welding circumferentially. As shown in FIG. 6, a cylindrical part 39 of the housing 7 and a peripheral edge of the top end portion of the air tube 35 are joined by welding circumferentially.

In the pneumatic pumping device of the above construction, since the bellows 4 and the housing 7 as well as the housing 7 and the air tube 35 are circumferentially joined by welding, the joined portions are perfectly closed and the entrance of liquid thereinto is exactly prevented. When operating the pumping device in a liquid, there is no possibility of entrance of the liquid from the outside.

Figure 8:
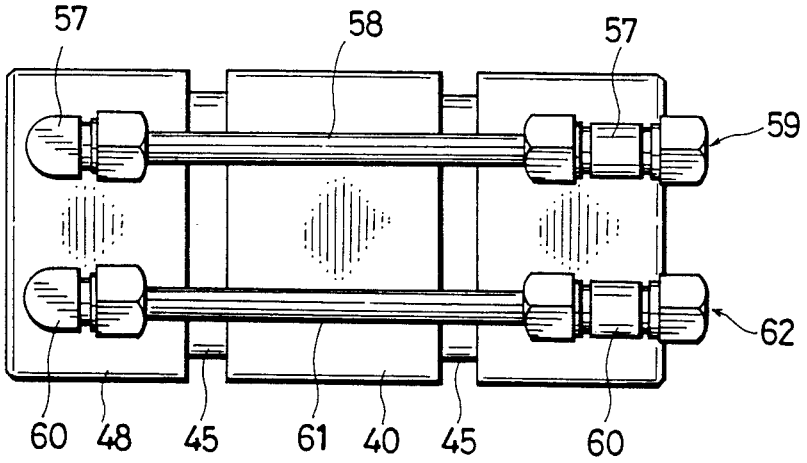
FIG. 8 is a plan view of a pumping device according to a fourth embodiment of the invention.
Figure 9:
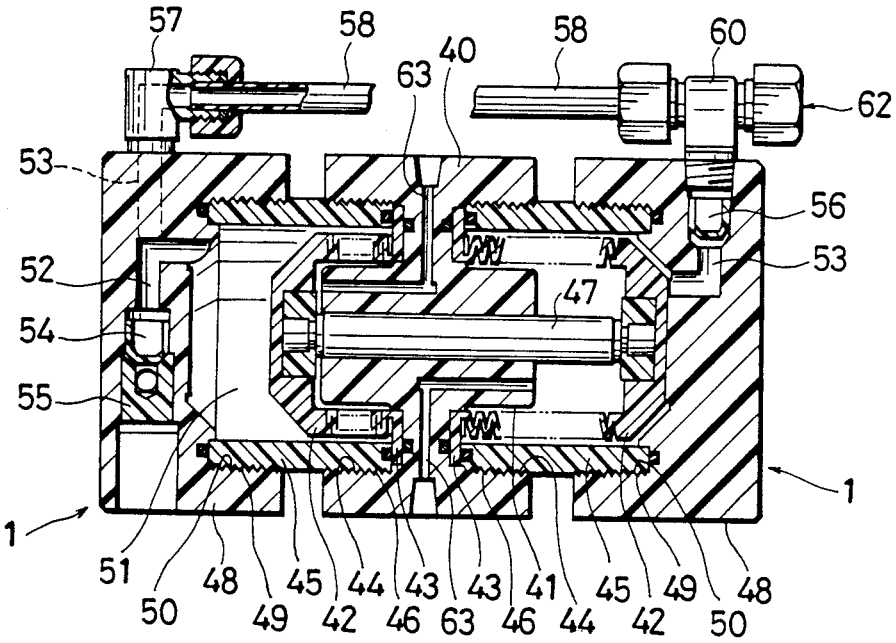
FIG. 9 is a sectional view of the pneumatic pumping device shown in FIG. 8.

FIG. 8 and FIG. 9 show a horizontal pumping device, wherein cylindrical concaves 41, 41 formed on both left and right end portions of the housing 40 located in the center are inserted into the flanges 43, 43 of the bellows 42, 42. Female threads 44, 44 are formed on the inner periphery of the concaves 41, 41 and male threads 46, 46 on the inner ends of the cylinder walls 45, 45 are engaged with the female threads 44, 44 so as to secure the flanges 43, 43 of the bellows 42, 42. A piston rod 47 is slidably inserted in the central portion of the housing 40, and the heads of the bellows 42, 42 are coupled with both ends of the piston rod 47. The coupling is established such that one bellows 42 is in its drawing in operation when the other bellows 42 is in its discharging operation. Outer housings 48, 48 whose external appearance is square are disposed on the outer ends of each cylinder wall 45, 45. A cylindrical concave is formed on the inside of each of the housings 48, 48, and male threads 50, 50 on the outer ends of the cylinder walls 45, 45 are engaged with female threads 49, 49 formed on the inner walls of the concaves.

Cylinder chambers 51 are formed with the housings 40, cylinder walls 45 and outer housings 48, one on the left side and the other on the right side, so that two pumps 1, 1 are formed. An intake passage 52 and a discharging passage 53 are formed in the outer housings 48, 48. A check valve 54 and a valve seat 55 permitting inhalation of liquid are disposed in the intake passage 52, while a check valve 56 permitting discharge of the liquid is disposed in the discharging passage 53. Furtheremore, fittings 57, 57 are fitted to the intake passages 52, 52 on both sides, and a pipe 58 is connected with the fittings 57, 57 thereby forming an intake channel port 59, while fittings 60, 60 are fitted to the discharging passages 53, 53 on both sides thereby forming a discharging channel port 62. Air passages 63, 63 communicating with each bellows 42, 42 on both sides are formed in the housing 40 located in the center.

In the same manner as the preceding first embodiment described above with reference to FIG. 1 and FIG. 2, the components of the pumps 1, 1 are all made of fluororesin, an air source for application of pressure is connected to one air passage 63 while a vacuum source to the other air passage 63, and the air source and the vacuum source are subject to change-over control.

In the pumping device of this embodiment, the bellows 42, 42 are alternately displaced between the intake side and discharging side by the aforementioned change-over control. Thus, liquid is drawn in through the intake passage 52 and by way of the check valve 54 when the bellows 42 is situated on the inhaling side, while the liquid is discharged through the discharging passage 53 and check valve 56 when the bellows 42 is situated on the discharging side.

Figure 10:
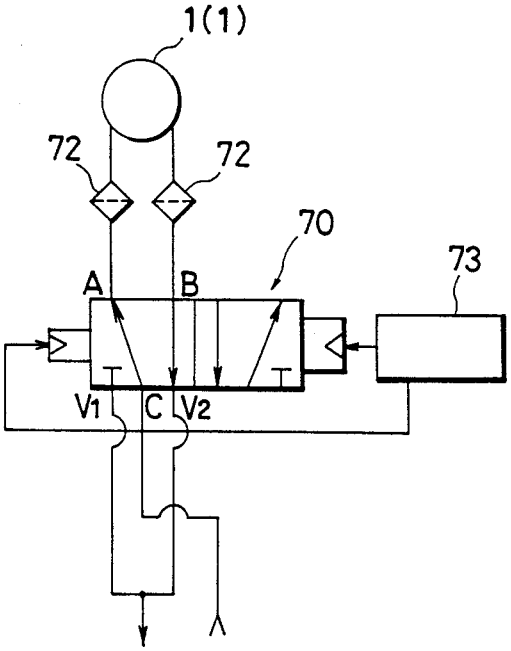
FIG. 10 is a diagram of an air change-over control circuit.

The air change-over control circuit shown in FIG. 10 is provided with an electromagnetic five-port-two-position change-over valve 70. In the change-over valve 70, the air source for application of pressure is connected to a port C, and the vacuum source to ports V1 and V2. Ports A and B are connected to each air passage by way of filters 72, 72. The electromagnetic coils on both sides of the change-over valve 70 are alternately switched through change-over control by a timer circuit 73. Accordingly, in the pumps 1, 1, each air passage is alternately changed over to the air side and the vacuum side according to the change-over control of the change-over valve 70 by the timer circuit 73, resulting in pumping operation being continuously carried out.

Figure 11:
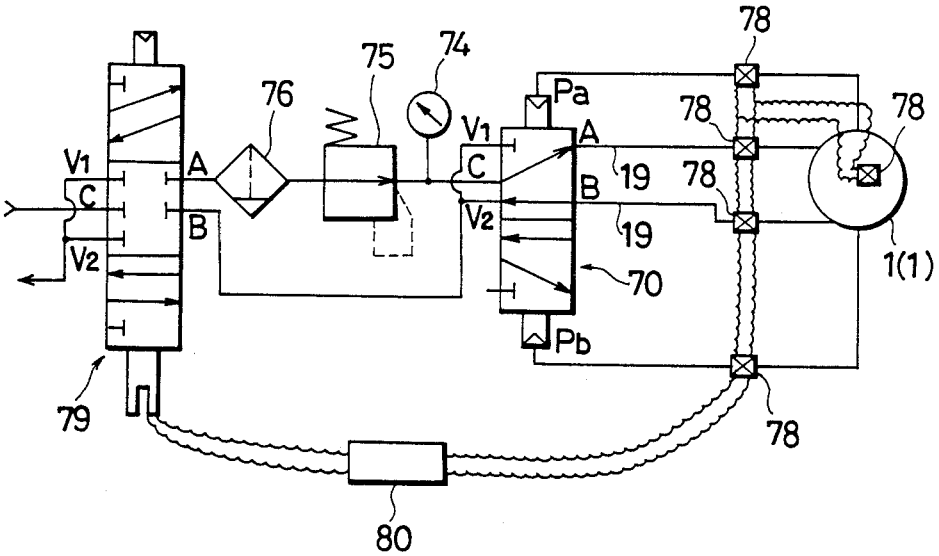
FIG. 11 is a diagram of a modified air change-over control circuit.

FIG. 11 shows an embodiment in which the air change-over control circuit is provided with liquid leakage detectors. In a pilot operated five-port two-position change-over valve 70 of the air change-over control circuit, the air source for application of pressure is connected to the port C, while the vacuum source to the ports V1 and V2. Further, a pressure gauge 74 for measuring and indicating the air pressure, a pressure regulator 75 for regulating the air pressure to a setup pressure, and a filter 76 for eliminating dust contained in the air are respectively connected with an air pressure application line to the port C. Each port A, B is connected to each air passage of the pumps 1, 1 by way of the liquid leakage detectors 78 . . . , and the pilot port is also connected to the pumps 1, 1 by way of the liquid leakage detectors 78 . . . . The liquid leakage detectors 78 output liquid leakage detection signals when any liquid leakage occurs in the air passage. A solenoid operated five-port-two-position change-over valve 79 is provided upstream of the filter 76. A line from the filter 76 is connected to the port A of the change-over valve 79, and each port V1, V2 of the change-over valve 70 located downstream is connected to the port B. The air source is connected to the port C of the changeover valve 79 located upstream, and the vacuum source is connected to each port V1, V2.

A signal of the liquid leakage detector 78 is amplified by the amplifier 80, and the electromagnetic solenoid of the change-over valve 79 is operated by the amplified signal to change over the valve. Once the valve is changed over, the line for air and the vacuum is closed, and the pumps 1, 1 stop their operation. Air and vacuum are alternately fed to each air passage of the pumps 1, 1 with the change-over operation of the pilot port in the change-over valve 70.

In the control circuit of above construction, if a strong acid liquid or strong alkaline liquid should leak out and enter such parts as the air passages 19, 19 or pilot ports Pa, Pb situated on the vacuum side due to break down of the bellows of the pump, for example, the liquid is detected by the liquid leakage detector 78 and operation of the pumps 1, 1 stop. Accordingly, when the pumps are provided with some other air devices, those devices are exactly protected from deterioration caused by the liquid.

Figure 12:
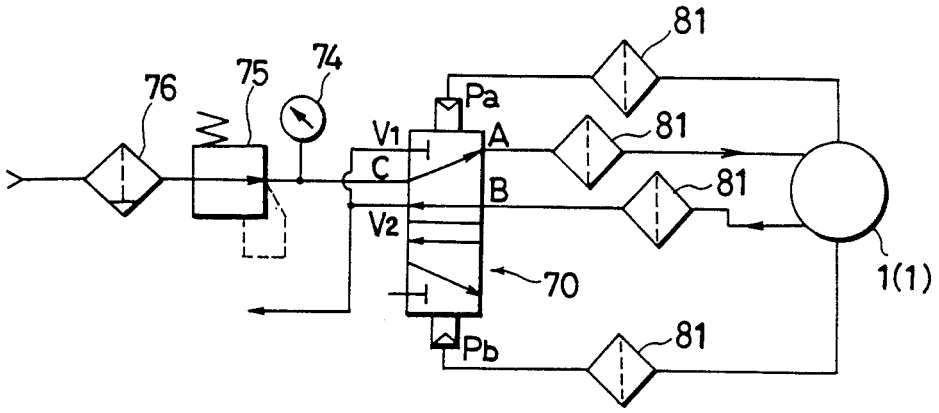
FIG. 12 is a diagram of a further modified air change-over control circuit.

FIG. 12 shows an embodiment with filters 81 of a porous tetrafluoroetylene resin formed by drawing, which is mounted on the air change-over control circuit. The filters 81 are of highly corrosion resistant material and perform a function of permitting gas to get therethrough while inhibiting liquid from passing therethrough, i.e., gas-permeable but not liquid-permeable. In the pilot operated five-port-two-position change-over valve 70, the pilot ports are changed over to each other so that the air source and the vacuum cource are alternately communicated with each air passage of the pumps 1, 1, resulting in the pumps 1, 1 performing their pumping operation.

According to this embodiment, even if a strong acid or a strong alkaline liquid should enter the air passage or the pilot port being in the vacuum state, the liquid is shut off by the filters 81 . . . , and the air passsage portions downstream of the filters 81 . . . are protected from corrosion.

It should be understood by those skilled in the art that the foregoing relates to only preferred embodiments of the invention, and that various changes and modifications may be made in the invention without departing from the spirit and scope thereof.

What is claimed is:

1. A pneumatic pumping device, comprising:

a plurality of cylinder chambers;

a pumping element situated in each cylinder chamber and mounted to reciprocate therein, said cylinders and associated pumping elements being arranged in a row;

change-over control means for alternately applying pressure and vacuum to each cylinder chamber producing the reciprocal movement of each pumping element thereby effecting the intake and discharge of a liquid from said chambers, wherein the surfaces of the chambers and pumping elements in contact with the liquid are formed of at least one of the following fluororesins: PTFE, PFA and CTFE; and a highly corrosion resistant filter, which is gas-permeable but not liquid-permeable, disposed in an air passage of the pumping device.

2. A pneumatic pumping device according to claim 1, wherein each cylinder and movable valve member are formed of at least one of the following fluororesins: PTFE, PFA and CTFE.

3. A pneumatic pumping device according to claim 1, wherein each movable valve member comprises a bellows.

4. A pneumatic pumping device according to claim 1, wherein each movable valve member comprises a diaphragm.

5. A pneumatic pumping device, comprising:

a plurality of cylinder chambers;

a pumping element situated in each cylinder chamber and mounted to reciprocate therein, said cylinders and associated pumping elements being arranged in a row;

change-over control means for alternately applying pressure and vacuum to each cylinder chamber producing the reciprocal movement of each pumping element thereby effecting the intake and discharge of a liquid from said chambers, wherein the surfaces of the chambers pumping elements in contact with the liquid are formed of at least one of the following fluororesins: PTFE, PFA and CTFE;

a housing associated with each pumping element for fixing said pumping element into its associated cylinder; and an air tube inserted into each housing for applying air pressure to the pumping element, wherein a joining portion between each pumping element and its associated housing is circumferentially welded, and a joining portion between each housing and its associated air tube is circumferentially welded.

6. A pneumatic pumping device according to claim 5, wherein each cylinder and pumping element are formed of at least one of the following fluororesins: PTFE, PFA and CTFE.

7. A pneumatic pumping device according to claim 5, wherein each pumping element comprises a bellows.

8. A pneumatic pumping device according to claim 5, wherein each pumping element comprises a diaphram.

* * * * *